US008339326B2

(12) United States Patent
Guler et al.

(10) Patent No.: US 8,339,326 B2
(45) Date of Patent: Dec. 25, 2012

(54) ANTENNA POLARIZATION CONTROL

(75) Inventors: Michael G. Guler, Dawsonville, GA (US); Eric L. Cross, Alpharetta, GA (US); Terence D. Newbury, Hoschton, GA (US)

(73) Assignee: EMS Technologies, Inc., Norcross, GA (US)

( * ) Notice: Subject to any disclaimer, the term of this patent is extended or adjusted under 35 U.S.C. 154(b) by 483 days.

(21) Appl. No.: 12/582,440

(22) Filed: Oct. 20, 2009

(65) Prior Publication Data

US 2010/0109960 A1 May 6, 2010

Related U.S. Application Data

(60) Provisional application No. 61/106,907, filed on Oct. 20, 2008.

(51) Int. Cl.
*H01Q 19/00* (2006.01)

(52) U.S. Cl. ..... 343/754; 343/756; 343/759; 343/766

(58) Field of Classification Search ..... None
See application file for complete search history.

(56) References Cited

U.S. PATENT DOCUMENTS

| | | | | |
|---|---|---|---|---|
| 4,792,812 | A | 12/1988 | Rinehart | |
| 5,287,115 | A | 2/1994 | Walker et al. | |
| 5,467,100 | A * | 11/1995 | Chen | 343/770 |
| 5,929,819 | A * | 7/1999 | Grinberg | 343/754 |
| 6,999,036 | B2 * | 2/2006 | Stoyanov et al. | 343/765 |
| 8,068,053 | B1 * | 11/2011 | Stutzke et al. | 342/75 |
| 2002/0089462 | A1 * | 7/2002 | Monzon | 343/761 |
| 2005/0062661 | A1 | 3/2005 | Zagiiloul et al. | |
| 2008/0018545 | A1 | 1/2008 | Kaplan et al. | |
| 2008/0291101 | A1 * | 11/2008 | Braunstein et al. | 343/754 |

OTHER PUBLICATIONS

International Search Report, PCT/US2009/061315, Dec. 15, 2009, pp. 1-3.

* cited by examiner

*Primary Examiner* — Trinh Dinh
(74) *Attorney, Agent, or Firm* — Fogg & Powers LLC

(57) ABSTRACT

Controlling an antenna's polarization sense. An antenna system includes a polarized antenna and a mechanism for controlling the polarization sense of the antenna. The controlling mechanism can include rotatable polarizer panels disposed between the antenna's aperture and the antenna's target. The polarizer panels are rotated to switch between polarization senses. The polarizer panels can comprise meander line polarizers that convert the polarization sense of a linear polarized antenna to a circularly polarized antenna and vice-versa. The meander line polarizers can be rotated from a position in which the meander line polarizer panels convert between linear polarization and right-hand-circular ("RHC") polarization to a position that converts between linear polarization and left-hand-circular ("LHC") polarization. The polarizer panels can be rotated using a mechanical system that rotates the polarizer panels based on a signal received from a remote device.

28 Claims, 4 Drawing Sheets

ANTENNA POLARIZATION CONTROL

RELATED PATENT APPLICATION

This non-provisional patent application claims priority under 35 U.S.C. §119 to U.S. Provisional Patent Application No. 61/106,907, entitled, "Remote Polarization Switching Mechanism," filed Oct. 20, 2008, the complete disclosure of which is hereby fully incorporated herein by reference.

TECHNICAL FIELD

The invention relates generally to antenna polarization, and more particularly to an antenna system having a mechanism for remotely controlling the polarization sense of an antenna.

BACKGROUND

Radio waves are electromagnetic waves that are commonly used to communicate data between antennas. In general, most antennas radiate either linear or circularly polarized radio waves. A linear polarized antenna radiates with its electric field wholly in one plane containing the direction of the radio wave's propagation. Linear polarization is typically classified as either being vertical or horizontal. This classification is determined based upon the electrical field plane of the radio wave radiated by the antenna. An antenna is said to be vertically polarized when its electric field is perpendicular to the Earth's surface and horizontally polarized when its electric field is parallel to the Earth's surface. Additionally, intermediate angles between vertical and horizontal are also possible. A polarization having an intermediate angle is commonly called slant polarization.

In a circularly polarized antenna, the electric field rotates in a circular pattern around the propagation direction making one complete revolution during each wavelength. If the rotation as a function of time is clockwise looking in the direction of propagation, the polarization sense is called right-hand-circular ("RHC") polarization. If the rotation is counterclockwise, the polarization sense is called left-hand-circular ("LHC") polarization.

A common method for increasing the data capacity of radio waves within a specified frequency bandwidth involves controlling the radio wave's polarization. Antennas can be designed to transmit and receive a specific polarization, such as a specific linear polarization or a specific circular polarization. Data capacity can be increased by simultaneously using the same frequency spectrum at the orthogonal polarization. Conventional antenna designs allow for a single antenna to transmit and receive two orthogonal polarizations by using two separate ports. However, these designs are more complex and more expensive than single polarization designs. Dual polarization designs can employ a set of radiators with one polarization and an independent set of radiators with the orthogonal polarization. Alternatively, dual polarization designs can employ a single set of radiators, each of which provide two ports for the two orthogonal polarizations. Both methods are significantly more complex than a single port, single polarization design. What is needed in the art is a cost-effective mechanism for switching or controlling the polarization sense of a single polarization antenna. Another need exists in the art for a mechanism that allows for remote controlling or switching of an antenna's polarization sense.

SUMMARY

An antenna system described herein allows for polarization control. The antenna system includes a polarized antenna and a mechanism for controlling or switching the antenna's polarization sense. The mechanism for controlling or switching the polarization sense includes rotatable polarizer panels disposed over the antenna's aperture between the antenna and the antenna's target. The polarizer panels can be rotated to switch between various polarization conversions. For example, the polarizer panels can comprise meander line polarizers that convert the polarization sense of a linear polarized antenna to a circularly polarized antenna and vice-versa. The meander line polarizers can be rotated from a position in which the meander line polarizer panels convert between linear polarization and right-hand-circular ("RHC") polarization to a position that converts between linear polarization and left-hand-circular ("LHC") polarization.

The rotation of the polarizer panels can be controlled using a gear-based system that rotates the polarizer panels based on a control signal received from a remote control device. Each of the polarizer panels can be attached to a respective panel gear. A motor coupled to a gear drive receives the control signal and rotates the gear drive in a direction based on the control signal. The gear drive meshes with one of the gear panels and rotates that gear panel and its polarizer panel. Adjacent panel gears can be meshed together such that the one motor can rotate each of the panel gears. Alternatively, each panel gear can be driven independently by a direct drive motor or a belt-drive system may be used to rotate the panel gears.

In one aspect of the present invention, an antenna system includes an antenna for transmitting radio waves having a first polarization and polarizer panels disposed proximate to the antenna. Each polarizer panel includes a polarization filter for converting the first polarization to two or more second polarizations based on the orientation of each polarization filter with respect to the antenna. The antenna system also includes a mechanism for altering the orientation of each polarizer panel from a first orientation to a second orientation. In the first orientation the polarization filter of each polarizer panel converts the first polarization to one of the second polarizations. In the second orientation the polarization filter of each polarizer panel convert the first polarization to another of the second polarizations.

For another aspect of the present invention, an antenna system includes an antenna for transmitting radio waves having a first polarization and polarization elements disposed along an aperture of the antenna. A controller can alter the orientation of each polarization element from a first orientation to a second orientation. In the first orientation the polarization elements convert the first polarization to a second polarization. In the second orientation the polarization elements convert the first polarization to a third polarization.

Another aspect of the present invention provides a method for remotely switching a polarization sense of an antenna. A signal is received from a remote device to switch from a first polarization sense to a second polarization sense. The positions of polarizer panels comprising polarization elements are moved from a first orientation corresponding to the first polarization sense to a second orientation corresponding to the second polarization sense. The polarizer panels are disposed along an aperture of the antenna.

For another aspect of the invention, an antenna system includes a dual-polarized antenna having a first port and a second port and polarization elements positioned proximate to the antenna. A controller can alter the orientation of each polarization element from a first orientation to a second orientation. In the first orientation the polarization elements convert radio waves transmitted by the antenna at the first port to a first polarization and convert radio waves transmitted by the antenna at the second port to a second polarization. In the second orientation the polarization elements convert radio waves transmitted by the antenna at the first port to a third polarization and convert radio waves transmitted by the antenna at the second port to a fourth polarization.

These and other aspects, objects, features, and embodiments of the invention will become apparent to a person of ordinary skill in the art upon consideration of the following detailed description of illustrative embodiments exemplifying the best mode for carrying out the invention as presently perceived.

BRIEF DESCRIPTION OF THE DRAWINGS

For a more complete understanding of the invention and the advantages thereof, reference is now made to the following description, in conjunction with the accompanying figures briefly described as follows.

DETAILED DESCRIPTION OF EXEMPLARY EMBODIMENTS

The exemplary embodiments operate to control or vary an antenna's polarization sense. An antenna system includes a polarized antenna and a mechanism for switching the polarization sense of the antenna. The switching mechanism can include rotatable polarizer panels disposed between the antenna's aperture and the antenna's target. The polarizer panels are rotated to switch between polarization senses. The polarizer panels can comprise meander line polarizers that convert the polarization sense of a linear polarized antenna to a circularly polarized antenna and vice-versa. The meander line polarizers can be rotated from a position in which the meander line polarizer panels convert between linear polarization and right-hand-circular ("RHC") polarization to a position that converts between linear polarization and left-hand-circular ("LHC") polarization. The polarizer panels can be rotated using a mechanical system that rotates the polarizer panels based on a signal received from a remote device.

Figure 1:
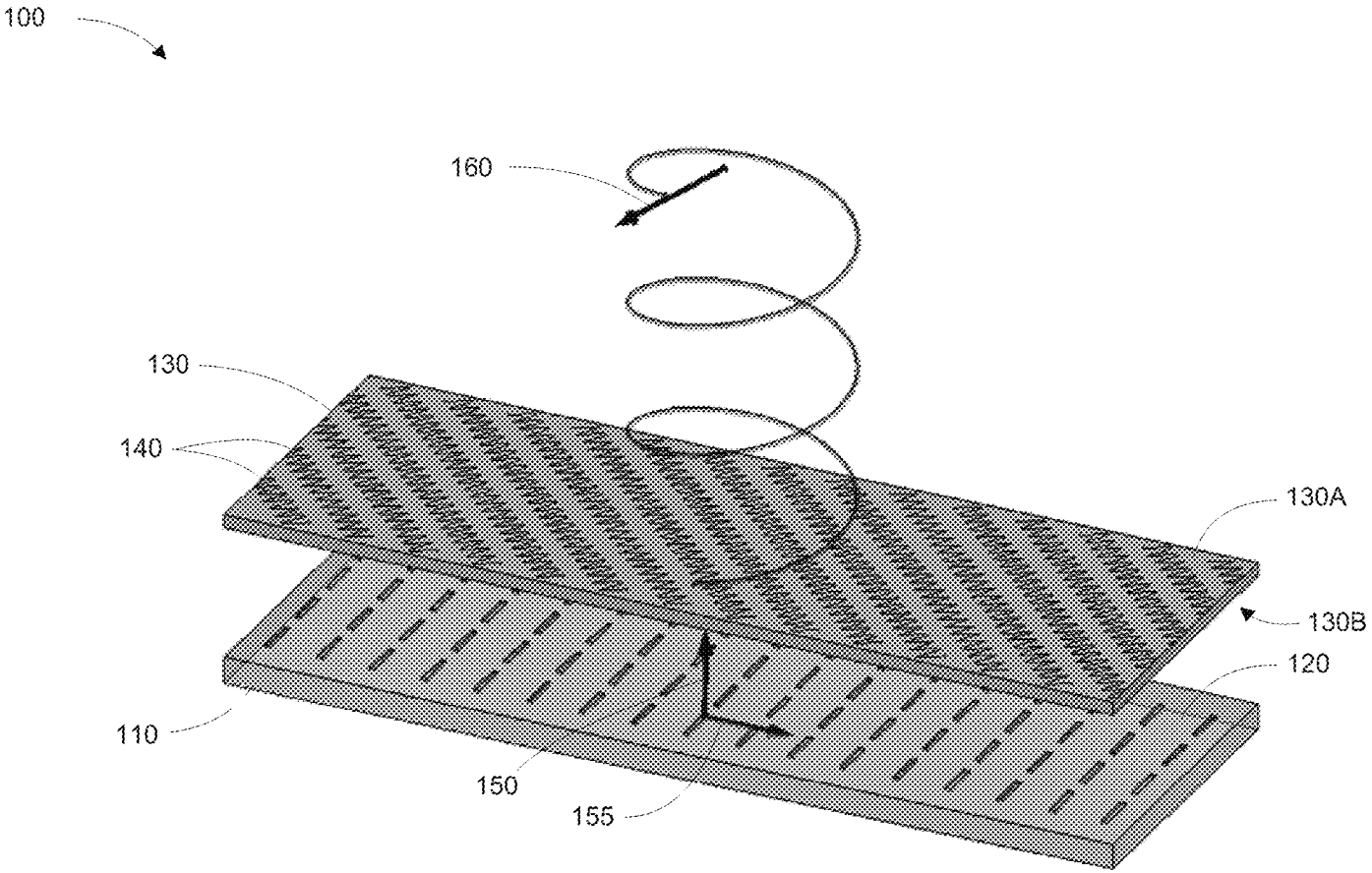
FIG. 1 is an exploded view of an antenna system having a linear polarized slot array antenna and a meander line polarizer in accordance with certain exemplary embodiments.

Turning now to the drawings, in which like numerals indicate like elements throughout the figures, exemplary embodiments are described in detail. FIG. 1 is an exploded view of an antenna system 100 having a linear polarized slot array antenna 110 and a meander line polarizer 130 in accordance with certain exemplary embodiments. In other exemplary embodiments, any linear polarized antenna could be used in the antenna system 100. Referring to FIG. 1, in this exemplary embodiment the linear polarized slot array antenna 110 transmits horizontal linear polarized radio waves. The direction of the horizontal polarization is indicated by arrow 155. The horizontal linear polarized radio waves are radiated by the antenna 110 in a direction perpendicular to the antenna's 110 aperture 120 as indicated by arrow 150. The antenna 110 can also receive radio waves of any polarization although there is an energy loss associated with non-horizontal polarizations.

The polarization sense of an antenna can be altered by placing a polarizing filter or polarization converter, such as meander line polarizer 130, between the antenna and the antenna's target. For example, the meander line polarizer 130 can transform the horizontal linear polarized antenna 110 into an antenna that is sensitive to circular polarization. The meander line polarizer 130 can also transform a circularly polarized antenna (not shown) into an antenna that is sensitive to linear polarization. Other polarizers can reorient an antenna's linear polarization direction to a different linear polarization direction. For example, a polarizer can be configured to reorient a horizontal linear polarization into a vertical or slant linear polarization. Additionally, other polarizers can convert between RHC and LHC polarizations.

The meander line polarizer 130 is disposed between the aperture 120 of the antenna 110 and the antenna's 110 target (not shown) to transform horizontal linear polarized radio waves radiated by the antenna 110 into RHC polarized radio waves. Because the meander line polarizer 130 is a reciprocal device, RHC polarized radio waves passing through the meander line polarizer 130 to the antenna 110 is converted to horizontal linear polarized radio waves. Thus, the meander line polarizer 130 allows the horizontal linear polarized antenna 110 to act as a circularly polarized antenna.

Meander line polarizers are typically constructed from one or more circuit board layers, each circuit board layer comprising an array of parallel meandering conductors 140. The meandering conductors 140 can be fabricated onto a circuit board via a chemical etch process. An insulator can be disposed between adjacent circuit board layers. The meandering conductors 140 are oriented on the circuit board so that each is inclined at an angle of 45 degrees to the linear polarization direction of the antenna 110 as indicated by arrow 155.

When the meandering conductors 140 are arranged at +/−45 degrees relative to the antenna's 110 horizontal linear polarization 155, the meander line polarizer 130 converts the horizontal linear polarization 155 to circular polarization. For example, as shown in FIG. 1, when the meandering conductors 140 are rotated 45 degrees in a clockwise direction with respect to the antenna's 110 horizontal polarization 155, the meander line polarizer 130 converts the horizontal polarization into RHC polarization as indicated by vector 160. Note that the rotation of the vector 160 in FIG. 1 is shown as a function of time, for a wave propagating away from the antenna 110. If the meandering conductors 140 are rotated 45 degrees in a counterclockwise direction with respect to the antenna's 110 horizontal polarization 155, the meander line polarizer 130 converts the horizontal polarization 155 into LHC polarization.

The meander line polarizer 130 can be reoriented to switch between an RHC conversion of the horizontal linear polarization 155 and an LHC conversion of the horizontal polarization 155. For example, the meander line polarizer 130 can be switched from RHC conversion as shown in FIG. 1 to LHC conversion by flipping the meander line polarizer 130 horizontally or vertically from its arrangement in FIG. 1. After flipping the meander line polarizer 130 either horizontally or vertically, an upper surface 130A of the meander line polarizer 130 faces the antenna 110 and a lower surface 130B of the meander line polarizer 130 faces in the direction of propagation. In this orientation, the meandering conductors 140 are rotated 45 degrees counterclockwise with respect to the horizontal polarization 155 which results in LHC conversion of the horizontal linear polarization 155. In many antenna installations, flipping a polarizer is not possible or is at least impractical. For example, a radome of an aircraft in which the antenna system 100 is installed may not have sufficient volume to allow for such flipping.

In another example, the meander line polarizer 130 can be rotated about an axis of rotation at or near the center and perpendicular to the surface 130A of the meander line polarizer 130. To switch from RHC conversion as shown in FIG. 1 to LHC conversion, the meander line polarizer 130 can be rotated 90 degrees in the counterclockwise direction about the axis of rotation. However, because the antenna 110 and the meander line polarizer 130 both have a rectangular shape rather than a square shape, in this rotated position the meander line polarizer 130 would not completely cover the antenna 110's aperture 120. Thus, a portion of the radio waves transmitted or received by the antenna 110 would not be converted to the desired polarization resulting in a loss of energy.

Figure 2:
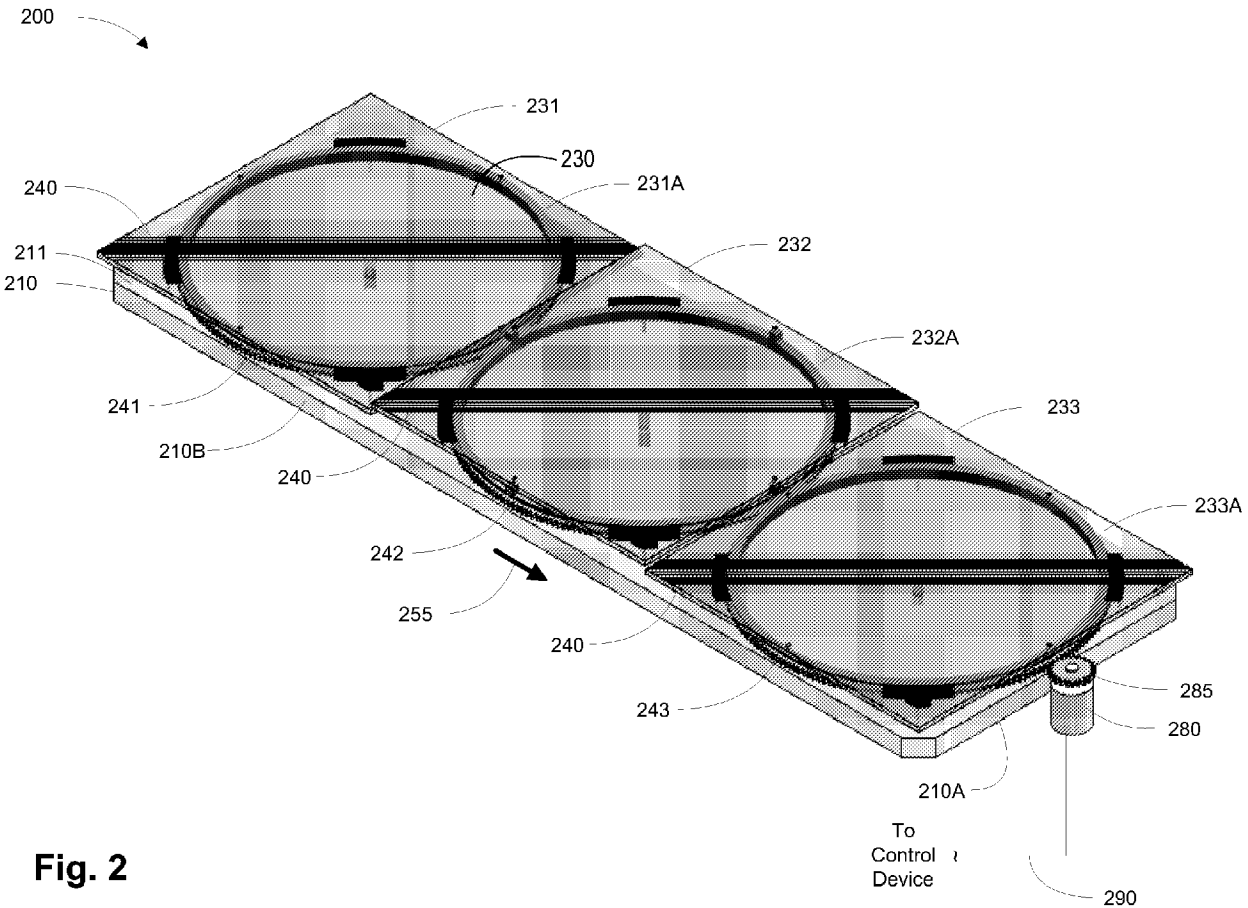
FIG. 2 is a side perspective view of an antenna system having a mechanism for controlling the polarization sense of an antenna in accordance with certain exemplary embodiments.
Figure 3:
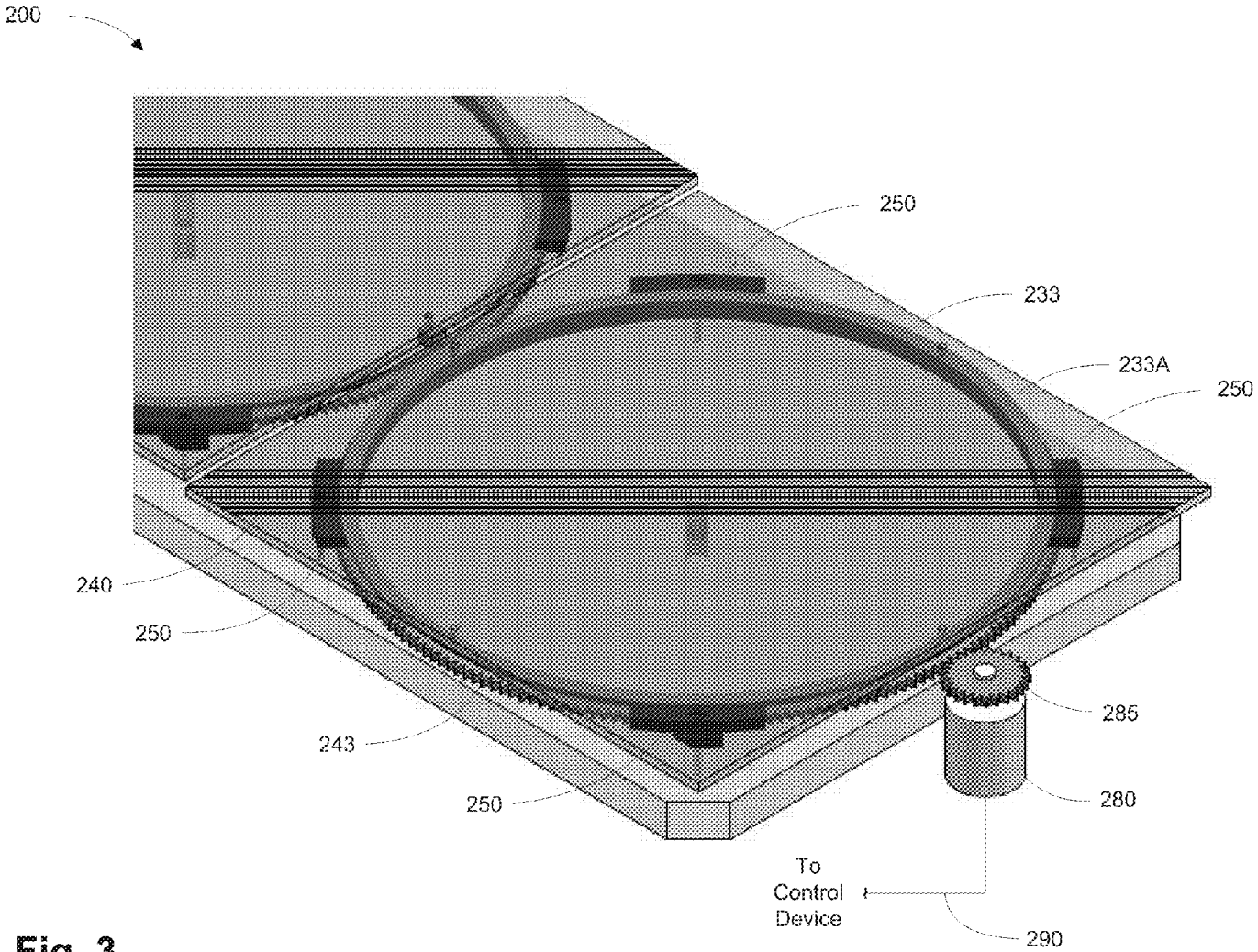
FIG. 3 is a detailed side perspective view of a portion of the antenna system of FIG. 2 in accordance with certain exemplary embodiments.

FIGS. 2 and 3 illustrate an antenna system 200 in accordance with certain exemplary embodiments. FIG. 2 is a side perspective view of the antenna system 200 having a mechanism for controlling the polarization sense of an antenna 210 in accordance with certain exemplary embodiments. FIG. 3 is a detailed side perspective view of a portion of the antenna system 200 of FIG. 2 in accordance with certain exemplary embodiments. The antenna system 200 provides a means for rotating a polarizer in a confined volume while also completely covering an antenna's aperture. The antenna system 200 also provides a means for remotely switching the polarization sense of an antenna.

Referring to FIGS. 2 and 3, the antenna system 200 includes an antenna 210 and three polarizer panels 231-233 distributed horizontally along the width of the antenna 210 to completely cover the antenna's 210 aperture 211. Each of the polarizer panels 231-233 can comprise a polarization filter element 230. In this exemplary embodiment, each of the polarizer panels 231-233 comprises a meander line polarizer. The polarizer panels 231-233 can include multiple circuit board layers, each circuit board layer having an array of parallel meandering conductors 240 similar to that of the meander line polarizer 130 of FIG. 1. Although the meandering conductors 240 can span the entire surface of each polarizer panel 231-233, only a portion of the meandering conductors 240 are illustrated in FIG. 2 for clarity.

The polarizer panels 231-233 are arranged such that the combination of the polarizer panels 231-233 provide substantially the same polarization conversion as a single meander line polarizer covering the same area that the polarizer panels 231-233 cover. In this exemplary embodiment, the polarizer panels 231-233 are substantially square-shaped with sides having lengths corresponding to the length of antenna 210 side 210A. As the length of antenna side 210B is approximately three times longer than the length of antenna side 210A, three polarizer panels 231-233 are required for complete coverage of the antenna aperture 211. Depending upon the aspect ratio of an antenna and the size of polarizer panels used in an antenna system, any number of polarizer panels may be needed to provide complete coverage of the antenna's aperture.

Although in this exemplary embodiment, one row of polarizer panels 231-233 are disposed adjacent to the antenna aperture 211, any number of rows can be used. For example, if the polarizer panels 231-233 have sides measuring half the length of antenna side 210A, two rows of 6 polarizer panels 231-233 could be used for complete coverage of the antenna aperture 211.

Each of the polarizer panels 231-233 is affixed to a round panel gear 241-243, respectively. The panel gears 241-243 are used to rotate the polarizer panels 231-233 in order to control or switch the polarization of the antenna 210. For example, if the antenna 210 is a horizontal polarized antenna as indicated by arrow 255, then the resultant polarization sense of the antenna system 200 as illustrated in FIG. 2 would be LHC as the meandering conductors are rotated 45 degrees counterclockwise with respect to the horizontal polarization 255. Each panel gear 241-243 can rotate its respective polarizer panel 90 degrees to change the resultant polarization sense of the antenna system 200 to RHC.

Each of the panel gears 241-243 is affixed to the antenna aperture 211 by way of four guides 250. The guides 250 constrain the polarizer panels 231-233 to a fixed (x, y, z) position, while allowing the polarizer panels 231-233 to rotate. Each of the polarizer panels 231-233 rotate about an axis perpendicular to surface 231A-233A of the polarizer panel 231-233 and substantially in the center of the surface 231A-233A. Adjacent panel gears 241-243 can support their respective polarizer panels 231-233 at different heights, with respect to the antenna aperture 211, to allow adjacent panel corners to overlap during rotation from one polarization state to another. For example, the polarizer panel 232 is supported at a greater distance from the antenna aperture 211 than adjacent polarizer panels 231 and 233.

As the panel gears 241-243 are disposed between the antenna's aperture 211 and the antenna's target (not shown), the panel gears 241-243 are preferably designed for minimum insertion loss and insertion phase within the antenna's 210 operating band of frequencies. The thickness and dielectric constant of the panel gears 241-243 can be optimized to simultaneously minimize reflections and match the insertion phases of energy that passes through the panel gears 241-243 versus energy that misses the panel gears 241-243. An example of this optimized condition is a gear with a dielectric constant of 4 and a thickness of 1 free space wavelength. The wavelength inside the gear is half of the free space wavelength, so energy passing through the gear experiences a phase shift of 720° (two cycles) and energy missing the gear experiences a phase shift of 360° (1 cycle) over a distance equal to the gear thickness. Therefore, after traveling a distance of the gear thickness, the two signals are matched in phase. In addition, if a dielectric material has a thickness such that the path through the material is an integer number of half cycles, then reflections off of the first face of the material cancel with reflections off of the second face, which minimizes total reflection.

In this exemplary embodiment, the antenna system 200 includes a single drive gear 285 that meshes with panel gear 243. The drive gear 285 can be rotated by a motor 280 which can be controlled from a remote location via a control device, such as a communication system (not shown). The control device can provide power to drive the motor 280 via electrical wiring 290 and thus rotate panel drive 285 which in turn rotates the panel gear 243 and polarizer panel 233. The panel gear 243 meshes with panel gear 242 and panel gear 242 also meshes with panel gear 241. Thus, when panel gear 243 is rotated by the drive gear 285, panel gear 243 causes panel gear 242 to rotate in an opposite direction than that of panel gear 243. In turn, panel gear 242 causes panel gear 241 to rotate in the same direction as panel gear 243, opposite that of panel gear 242. The motor 280 can be commanded to rotate in the reverse direction to reverse rotation of the gear drive 285 and thus the polarizer panels 231-233. To reduce gear backlash, it may be preferable to always rotate in the same direction to change from one polarization state to another.

The above described gear-based control mechanism provides a means for altering the orientation of the polarizer panels 231-233 to control the polarization sense of the antenna system 200. In the above described gear-based mechanism, a means for rotating each polarizer panel 231-233 comprises the motor 280 receiving a control signal from a remote control device and rotating the gear drive 285 which in turn rotates each of the panel gears 241-243 via meshing of the gear drive with one of the panel gears 243 and meshing of adjacent panel gears 241-243. Likewise, in the above described gear-based mechanism, a means for rotating the gear panels to alter the orientation of the polarizer panels 231-233 comprises the motor 280 receiving a control signal from a remote control device and rotating the gear drive 285 which in turn rotates each of the panel gears 241-243 via meshing of the gear drive with one of the panel gears 243 and meshing of adjacent panel gears 241-243. The rotation of the panel gears 241-243 provides rotation for the polarizer panels 231-233 that are attached to the panel gears 241-243.

In alternative embodiments, each panel gear 241-243 can be connected to a dedicated direct drive motor or other rotational device to support the rotation of its respective polarizer panel 231-233. In such an embodiment, each of the panel gears 241-243 can be controlled separately. The direct drive motor or other rotational device can each receive a signal from a remote control device and rotate its respective panel gear 241-243 in accordance with the signal. In another alternative embodiment, the panel gears 241-243 can be configured to be belt driven instead of gear-driven. Those skilled in the art having the benefit of the present disclosure would appreciate that there are many mechanical means for rotating the polarizer panels 231-233.

Although in this exemplary embodiment substantially square-shaped polarizer panels 231-233 are used, different shape polarizer panels could be used depending on the required quality of polarization conversion required. For example, round polarizer panels could be used to allow rotation without overlap. Round polarizer panels may not provide complete coverage of the antenna aperture 211, but the round polarizer panels may be sufficient to meet polarization requirements of a given system.

Figure 4:
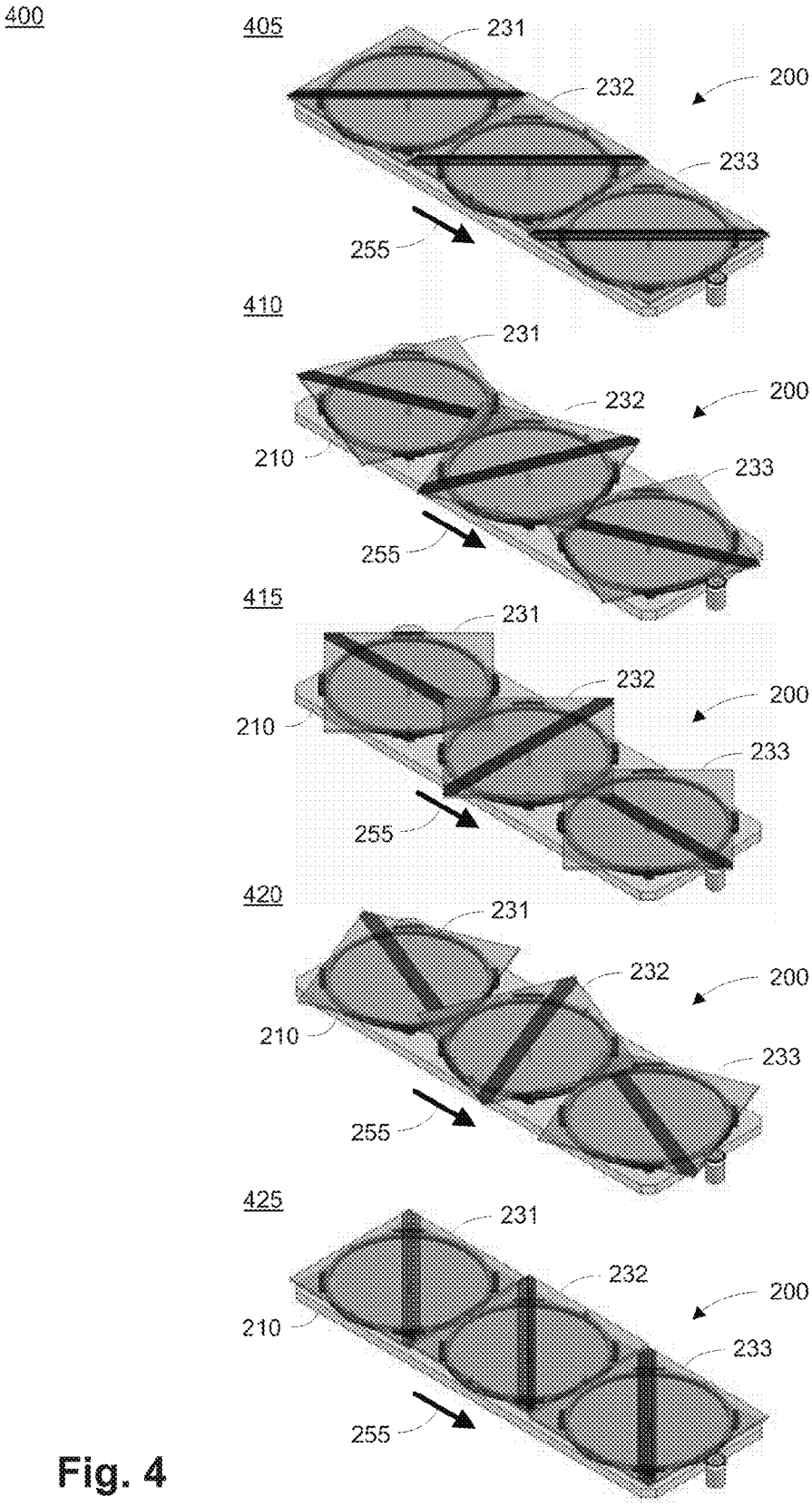
FIG. 4 depicts a method for converting the antenna system of FIG. 2 between left-hand-circular ("LHC") polarization and right-hand-circular ("RHC") polarization in accordance with certain exemplary embodiments.

FIG. 4 depicts a method 400 for converting the antenna system 200 of FIG. 2 between LHC polarization conversion and RHC polarization conversion in accordance with certain exemplary embodiments. Referring to FIGS. 2 and 4, in view 405, each of the polarizer panels 231-233 are rotated such that the meander line conductors 240 for each polarizer panel 231-233 are rotated 45 degrees counterclockwise with respect to the horizontal polarization 255 of the antenna 210. In this configuration, the polarizer panels 231-233 convert horizontal linear polarized radio waves radiated by the antenna 210 into LHC polarized radio waves. Because of reciprocity, LHC polarized radio waves passing through the polarizer panels 231-233 to be received by the antenna 210 is converted to horizontal linear polarized radio waves.

After the motor 280 receives a signal from the control device to switch from LHC conversion to RHC conversion, the motor 280 rotates the gear drive 285 in a counterclockwise direction. The gear drive 285 in turn rotates panel gear 243 in a clockwise direction. Because panel gear 243 meshes with panel gear 242, panel gear 243 causes panel gear 242 to rotate in a counterclockwise direction. Likewise, because panel gear 242 meshes with panel gear 241, panel gear 242 causes panel gear 241 to rotate in a clockwise direction.

The motor 280 continues to rotate the panel gears 241-243 by way of the gear drive 285 until the meandering conductors 240 of the polarizer panels 231-233 are rotated 45 degrees clockwise with respect to the horizontal polarization 255. That is, the motor 280 rotates each of the panel gears 241-243 90 degrees. In view 410, the panel gears 241-243 are rotated 22.5 degrees from the original position of view 405. In this view 410, corners of adjacent polarizer panels 231-233 begin to overlap during the rotation. In view 415, the panel gears 241-243 are rotated 45 degrees from the original position of view 405. In view 420, the panel gears 241-243 are rotated 67.5 degrees from the original position of view 405. Finally, in view 425, the panel gears have completed the rotation to RHC conversion whereby the meandering conductors are rotated 45 degrees clockwise with respect to the horizontal polarization 255. After the rotation is complete, the motor 280 is de-energized. Thus, by remotely commanding a motor 280 to turn the drive gear 285, a method 400 for remotely switching the antenna's 210 polarization sense is accomplished. The method 400 also works in reverse. The motor 280 can rotate the gear drive 285 in the clockwise direction to rotate the panel gears 241-243 and thus the polarizer panels 231-233 back to the position illustrated in view 405. Alternatively, the motor 280 can be commanded to rotate in the original counterclockwise direction to rotate the panel gears 241-243 and thus the polarizer panels 231-233 back to the position illustrated in view 405.

One of ordinary skill in the art would appreciate that the present invention provides systems and methods for controlling or switching an antenna's polarization sense. An antenna system includes a polarized antenna and a mechanism for controlling the polarization sense of the antenna. The controlling mechanism can include rotatable polarizer panels disposed between the antenna's aperture and the antenna's target. The polarizer panels are rotated to switch between polarization senses. The polarizer panels can comprise meander line polarizers that convert the polarization sense of a linear polarized antenna to a circularly polarized antenna and vice-versa. The meander line polarizers can be rotated from a position in which the meander line polarizer panels convert between linear polarization and RHC polarization to a position that converts between linear polarization and LHC polarization. The polarizer panels can be rotated using a mechanical system that rotates the polarizer panels based on a signal received from a remote device.

The present invention allows for the use of relatively simple antennas in applications that require switchable or variable polarizations. For example, the invention provides a useful method for transforming a fixed single polarization antenna into a selectable polarization antenna. The invention is especially useful in applications where the antenna is inaccessible and within a confined volume, such as airborne SATCOM, by allowing for polarization switching to take place under a radome with very slight or no increase in radome volume.

The invention can also be used to reverse or otherwise alter the polarization at each of the two ports of a dual-polarization antenna. For example, a dual-polarized antenna can include a first port having RHC polarization sense and a second port having LHC polarization sense. Rotating polarizer panels disposed proximate to the antenna can switch the first port to LHC polarization and the second port to RHC polarization. In another example, a dual-polarized antenna can include a first port for transmitting radio waves having a first linear polarization and a second port for transmitting radio waves having a second linear polarization orthogonal to the first linear polarization. Meander line polarizer panels can be used to convert each of the two linear polarizations to circular polarizations. In a first orientation, the polarizer panels may convert the linear polarization of the first port to RHC polarization and convert the linear polarization of the second port to LHC polarization. Rotating the polarizer panels to a second orientation as described above can switch the polarization sense of the first port to LHC polarization and the polarization sense of the second port to RHC polarization.

Although the exemplary embodiments have been described largely in terms of converting between linear and circular polarization, the invention can also used with any polarizing filter or element that depends on it relative orientation to the polarization being converted. Non-limiting examples of other polarizing elements include dipoles, slots, loops, and rings. Other types of polarization may require altered and/or additional polarizer panels. For example, continuously varying linear polarizations may require that each square or nearly square region covering an antenna's aperture have more than one independently rotating polarizing element.

The invention is also useful in mobile SATCOM systems that communicate via linearly polarized satellites and provide continuous polarization agility. The polarization angle of the satellite signal relative to a mobile platform is continuously varying depending on the latitude and longitude of the mobile platform and on the mobile platform's attitude in space. Multiple layers of rotating polarizing filters have been used to continuously vary an antenna's linear polarization angle so that it matches the satellite's polarization angle. The present invention can be employed to subdivide such a polarizer system into multiple, multilayer polarizing panels in a similar manner to the exemplary embodiments described above. Each subdivided panel could be driven to rotate synchronously to vary the polarization angle of the whole antenna.

Although specific embodiments have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. An antenna system, comprising:

an antenna that transmits or receives radio waves having a first polarization;

a plurality of polarization panels disposed along an aperture of the antenna; and a controller that alters the orientation of each polarization panel from a first orientation to a second orientation, wherein in the first orientation the polarization panels convert the first polarization to a second polarization and wherein in the second orientation the polarization panels convert the first polarization to a third polarization.

2. The antenna system of claim 1, wherein the controller alters the orientation of the polarization panels based on a signal received from a remote device.

3. The antenna system of claim 1, wherein the controller comprises a panel gear for each polarization panel, the polarization panel being attached to its respective panel gear in a manner such that when the panel gear is rotated the polarization panel is also rotated; and each panel gear is located between its respective polarization panel and the antenna.

4. The antenna system of claim 1, wherein the polarization panels are substantially square-shaped and adjacent polarization panels are offset in a manner such that when the polarization panels are rotated, corners of the adjacent polarization panels overlap.

5. The antenna system of claim 1, wherein each polarization panel comprises a meander line polarizer.

6. The antenna system of claim 1, wherein the antenna comprises a linear polarized antenna and, for the first orientation, the polarization panels convert linear polarized radio waves into right-hand-circular polarization and, for the second orientation, the polarization panels convert the linear polarized radio waves into left-hand-circular polarization.

7. A method for remotely controlling a polarization sense of an antenna, the method comprising:

receiving a signal from a remote device to switch from a first polarization sense to a second polarization sense; and controlling a rotation of each of a plurality of polarizer panels comprising polarization elements to rotate from a first orientation corresponding to the first polarization sense to a second orientation corresponding to the second polarization sense, wherein each of the plurality of polarizer panels is horizontally disposed along an aperture of the antenna.

8. The method of claim 7, wherein the antenna comprises a horizontal linear polarized antenna and the polarization elements comprise meander line polarizers.

9. The method of claim 7, wherein the controlling the rotations of the plurality of polarizer panels comprises rotating each of the polarizer panels 90 degrees about an axis perpendicular to a surface of the polarizer panel and substantially close to the middle of the surface.

10. The method of claim 7, wherein the first polarization sense comprises left-hand-circular polarization and the second polarization sense comprises right-hand-circular polarization.

11. The method of claim 7, wherein each polarizer panel is attached to a respective panel gear and wherein the controlling the positions of the plurality of polarizer panels comprises rotating the panel gears.

12. The method of claim 11, wherein the signal is received by a motor that rotates the plurality of panel gears.

13. The method antenna system of claim 7, further rotating the polarizer panels to a position over the antenna to substantially cover a surface area of the antenna.

14. An antenna system, comprising:

a dual-polarized antenna comprising a first port and a second port;

a plurality of polarization panels positioned adjacent to each other along a plane over the antenna; and a controller that alters the orientation of each polarization panel from a first orientation to a second orientation, wherein in the first orientation, the polarization panels convert radio waves transmitted by the antenna at the first port to a first polarization and convert radio waves transmitted by the antenna at the second port to a second polarization and wherein in the second orientation, the polarization panels convert radio waves transmitted by the antenna at the first port to a third polarization and convert radio waves transmitted by the antenna at the second port to a fourth polarization.

15. The antenna system of claim 14, wherein the first polarization and the fourth polarization comprise substantially similar polarizations and wherein the second polarization and the third polarization comprise substantially similar polarizations.

16. The antenna system of claim 15 wherein the first and fourth polarizations comprise right-hand-circular polarizations and the second and third polarizations comprise left hand-circular polarizations.

17. The antenna system of claim 14, wherein each polarization panel comprises a meander line polarizer.

18. The antenna system of claim 14, wherein each polarization panel is attached to a panel gear and wherein the controller alters the orientation of the polarization panels by rotating the panel gears.

19. An antenna system, comprising:

an antenna that transmits or receives radio waves having a first polarization;

a plurality of rotatable polarizer panels positioned adjacent to each other along a plane over the antenna;

a plurality of panel rotation devices, wherein each panel rotation device is located between a respective polarizer panel and the antenna and is coupled to the respective polarizer panel; and wherein each polarizer panel comprising a polarizer that converts the first polarization to a second polarization based on a rotational position of the polarizer panel.

20. The antenna system of claim 19, wherein the antenna system is configured so that:

each polarizer converts the first polarization to a right-handed circular (RHC) polarization when the respective polarization panel is oriented in a first rotational position; and each polarizer converts the first polarization to a left-handed circular (LHC) polarization when the respective polarization panel is oriented in a second rotational position.

21. The antenna system of claim 19, wherein adjacent polarizer panels comprise a respective vertical offset therebetween that is perpendicular to a respective surface of each adjacent polarizer panel so that corners of the adjacent polarizer panels overlap when the adjacent polarizer panels are rotated relative to each other.

22. The antenna system of claim 19, wherein the plurality of panel rotation device comprise a plurality of panel gears, wherein respective adjacent panel gears mesh together through contact and the panel gears are coupled to a gear drive that rotates the panel gears.

23. The antenna system of claim 19, wherein each panel rotation device is coupled to a respective dedicated drive motor that rotates the panel rotation device independent of each other panel rotation device.

24. The antenna system of claim 19, wherein the panel rotation devices are microwave transparent.

25. The antenna system of claim 19, wherein the plurality of panel rotation devices comprises at least one of: a plurality of panel gears that are gear driven and a plurality of panel rotation devices that are belt driven.

26. The antenna system of claim 19, wherein the respective polarizer of each polarizer panel comprises a respective meander line polarizer.

27. The antenna system of claim 19, wherein the rotatable polarizer panels are distributed horizontally along a width of the antenna to substantially cover a surface area or aperture area of the antenna.

28. The antenna system of claim 19, wherein each rotatable polarizer panel comprises an array of meandering conductors arranged in a first direction corresponding to a first rotational position and in a second direction corresponding to a second rotational position.

* * * * *

UNITED STATES PATENT AND TRADEMARK OFFICE

CERTIFICATE OF CORRECTION

PATENT NO. : 8,339,326 B2
APPLICATION NO. : 12/582440
DATED : December 25, 2012
INVENTOR(S) : Guler et al.

It is certified that error appears in the above-identified patent and that said Letters Patent is hereby corrected as shown below:

In the Claims

Column 10, Claim 13, Line 42, delete "antenna system".

Signed and Sealed this
Twenty-eighth Day of May, 2013

Teresa Stanek Rea
*Acting Director of the United States Patent and Trademark Office*